US010085099B2

(12) United States Patent
Kuriger et al.

(10) Patent No.: US 10,085,099 B2
(45) Date of Patent: Sep. 25, 2018

(54) HEARING AID SYSTEM, A HEARING AID DEVICE AND A METHOD OF OPERATING A HEARING AID SYSTEM

(71) Applicants: Bernafon AG, Bern (CH); Oticon A/S, Smørum (DK)

(72) Inventors: Martin Kuriger, Bern (CH); Christophe Lesimple, Bern (CH); Neil Hockley, Bern (CH); Claus Forup Corlin Jespersgaard, Smørum (DK); Thomas Ulrich Christiansen, Smørum (DK)

(73) Assignees: Bernafon AG, Berne (CH); Oticon A/S, Smørum (DK)

( * ) Notice: Subject to any disclaimer, the term of this patent is extended or adjusted under 35 U.S.C. 154(b) by 13 days.

(21) Appl. No.: 14/931,792

(22) Filed: Nov. 3, 2015

(65) Prior Publication Data

US 2017/0127200 A1 May 4, 2017

(51) Int. Cl.
*H04R 25/00* (2006.01)

(52) U.S. Cl.
CPC ..... *H04R 25/70* (2013.01); *H04R 25/353* (2013.01); *H04R 25/356* (2013.01); *H04R 25/554* (2013.01); *H04R 2225/55* (2013.01)

(58) Field of Classification Search
CPC ..... H04R 29/00; H04R 25/00; H04R 25/55; H04R 25/558; H04R 2225/49; H04R 2460/01
USPC ..... 381/60, 98, 312, 314–321
See application file for complete search history.

(56) References Cited

U.S. PATENT DOCUMENTS 5,014,319 A * 5/1991 Leibman ..... H04R 25/353 381/316
6,115,478 A * 9/2000 Schneider ..... H04R 25/558 381/312
6,236,731 B1 * 5/2001 Brennan ..... H03H 17/0266 381/312

(Continued)

FOREIGN PATENT DOCUMENTS

EP 2 026 601 A1 2/2009

OTHER PUBLICATIONS

Angelo et al., "Oticon Frequency Lowering Access to High-Frequency Speech Sounds with Speech Rescue Technology," Whitepaper, 2015, pp. 1-17.

(Continued)

*Primary Examiner* — Suhan Ni
(74) *Attorney, Agent, or Firm* — Birch, Stewart, Kolasch & Birch, LLP

(57) ABSTRACT

The application relates to a hearing aid system comprising a hearing aid device comprising a configurable signal processing unit, a programming device configured to program the configurable signal processing unit, and a communication link allowing the exchange of data between the hearing aid device and the programming device. The application further relates to a method of programming configurable signal processing unit to provide an increased speech intelligibility by frequency lowering. The hearing aid system is configured to program the configurable signal processing unit of the hearing device according the claimed method. The invention may e.g. be used in hearing aids.

9 Claims, 3 Drawing Sheets
(1 of 3 Drawing Sheet(s) Filed in Color)

(56) References Cited

U.S. PATENT DOCUMENTS

| | | | | |
|---|---|---|---|---|
| 6,240,192 | B1 * | 5/2001 | Brennan | H04R 25/505 381/312 |
| 7,778,426 | B2 * | 8/2010 | McDermott | H04R 25/453 381/98 |
| 8,000,487 | B2 * | 8/2011 | Fitz | H04R 25/353 381/312 |
| 8,351,626 | B2 * | 1/2013 | Hersbach | H04R 3/02 381/316 |
| 2004/0136555 | A1 * | 7/2004 | Enzmann | H04R 25/43 381/314 |
| 2004/0264721 | A1 * | 12/2004 | Allegro | H04R 25/353 381/316 |
| 2008/0123886 | A1 | 5/2008 | Andersen et al. | |
| 2010/0067721 | A1 | 3/2010 | Tiefenau | |
| 2011/0150256 | A1 * | 6/2011 | Baechler | H04R 25/353 381/316 |
| 2011/0249843 | A1 | 10/2011 | Holmberg et al. | |
| 2013/0051565 | A1 | 2/2013 | Pontoppidan | |
| 2014/0105435 | A1 | 4/2014 | Allegro-Baumann et al. | |

OTHER PUBLICATIONS

Kuriger et al., "Frequency Composition™ : A New Approach to Frequency Lowering," Bernafon, Dec. 2012, pp. 1-8.

* cited by examiner

HEARING AID SYSTEM, A HEARING AID DEVICE AND A METHOD OF OPERATING A HEARING AID SYSTEM

SUMMARY

The present application relates to a hearing aid system and to a hearing aid device and to a method of operating a hearing aid system. In an embodiment, the disclosure relates to a hearing aid system configured to make high frequency (sound) information available for a user, preferably optimized individually for a particular end-user to maximize speech intelligibility in a hearing aid.

For severe-to-profound hearing losses it is not always possible to supply sufficient amplification at higher frequencies (e.g. above 3-4 kHz) to make sounds audible to the user. Instead, high frequency content can be presented at lower frequencies. This process is called frequency lowering. In order for the listener to be able to use the frequency lowered information, it is important that the source regions and the destination frequencies match the end-user's hearing ability as described by the audiogram. Only in this situation can the end-user make full use of the added information when listening to speech.

A Hearing Aid System:

In an aspect of the present application, a hearing aid system comprising

- A hearing aid device comprising a configurable signal processing unit,
- A programming device configured to program the configurable signal processing unit, and
- A communication link allowing the exchange of data between the hearing aid device and the programming device is provided. The hearing aid system is configured to program the configurable signal processing unit of the hearing device according the method of programming a configurable signal processing unit of a hearing aid device as described below.

In an embodiment, the hearing aid system comprises of four components:

1. Frequency transposition algorithm in the hearing aid where content from more than one upper-lying (source) frequency band is copied into one and the same lower lying (destination) frequency band. Each combination of source regions and destination region is called a frequency transposition configuration.
2. A number of frequency transposition configurations. The bandwidth of each of the source and destination regions in a given frequency transposition configuration is denoted by an integer specifying the number of ERBs. (ERB=Equivalent rectangular bandwidth, frequency scale based on the human ear).
3. A weight parameter that specifies the amount of gain applied to the lowered signal.
4. A prescription algorithm that selects an optimum configuration for each ear of the end-user's ears taking the audiogram and the amplification capability of the hearing aid into account.

The four components described here ensures that exactly the right information used for decoding speech is made available to the individual hearing impaired ear. Components 1 and 2 selects source regions covering the high frequency bandwidth with relevant speech cues and components 3 and 4 ensures that these speech cues are presented optimally in terms of audibility. In this way the Frequency Lowering system proposed here is optimized as a whole.

The fact that more source regions are lowered to the same destination region reflects an optimized compromise between making a large amount of information available and distorting the original signal. Previously suggested transposition methods do not use this optimization and have not shown the performance that this method has in terms of speech intelligibility. Previously suggested frequency compression methods inherently do not have the flexibility to optimize the configurations described here.

The terms hearing aid device and hearing device are used interchangeably, and are intended to include a hearing aid (e.g. an air conduction type hearing aid, a bone conduction hearing aid, a fully or partially implanted hearing aid, e.g. a cochlear implant type hearing aid, and combinations thereof).

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing aid system as described above, in the 'detailed description of embodiments' and in the claims, is moreover provided. In an embodiment, use is provided in as a fitting system a hearing aid device, e.g. for one or more hearing aids, e.g. for a binaural hearing aid system.

A Method:

In an aspect, a method of programming a configurable signal processing unit of a hearing aid device, the method comprising

- Providing a frequency transposition algorithm in the hearing aid device where content from more than one upper-lying source frequency band is copied into one and the same lower lying destination frequency band is furthermore provided by the present application. The method further comprises
- Providing a number of frequency transposition configurations, each comprising a specific combination of source regions and a destination region;
- Providing a weight parameter that specifies the amount of gain applied to the lowered signal; and
- Providing a prescription algorithm that selects an optimum frequency transposition configuration for an ear of the user taking the audiogram for the ear in question and the amplification capability of the hearing aid device in question into account.

It is intended that some or all of the structural features of the system described above, in the 'detailed description of embodiments' or in the claims can be combined with embodiments of the method, when appropriately substituted by a corresponding process and vice versa. Embodiments of the method have the same advantages as the corresponding systems and vice versa.

In an embodiment, the user wears a hearing aid device at each ear. In an embodiment, the two hearing devices form part of a binaural hearing aid system (e.g. allowing an exchange of data between the two hearing aid devices).

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

Definitions

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing devices, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The patent or application file contains at least one color drawing. Copies of this patent or patent application publication with color drawing will be provided by the USPTO upon request and payment of the necessary fee.

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aid devices, e.g. hearing aids.

Figure 1:
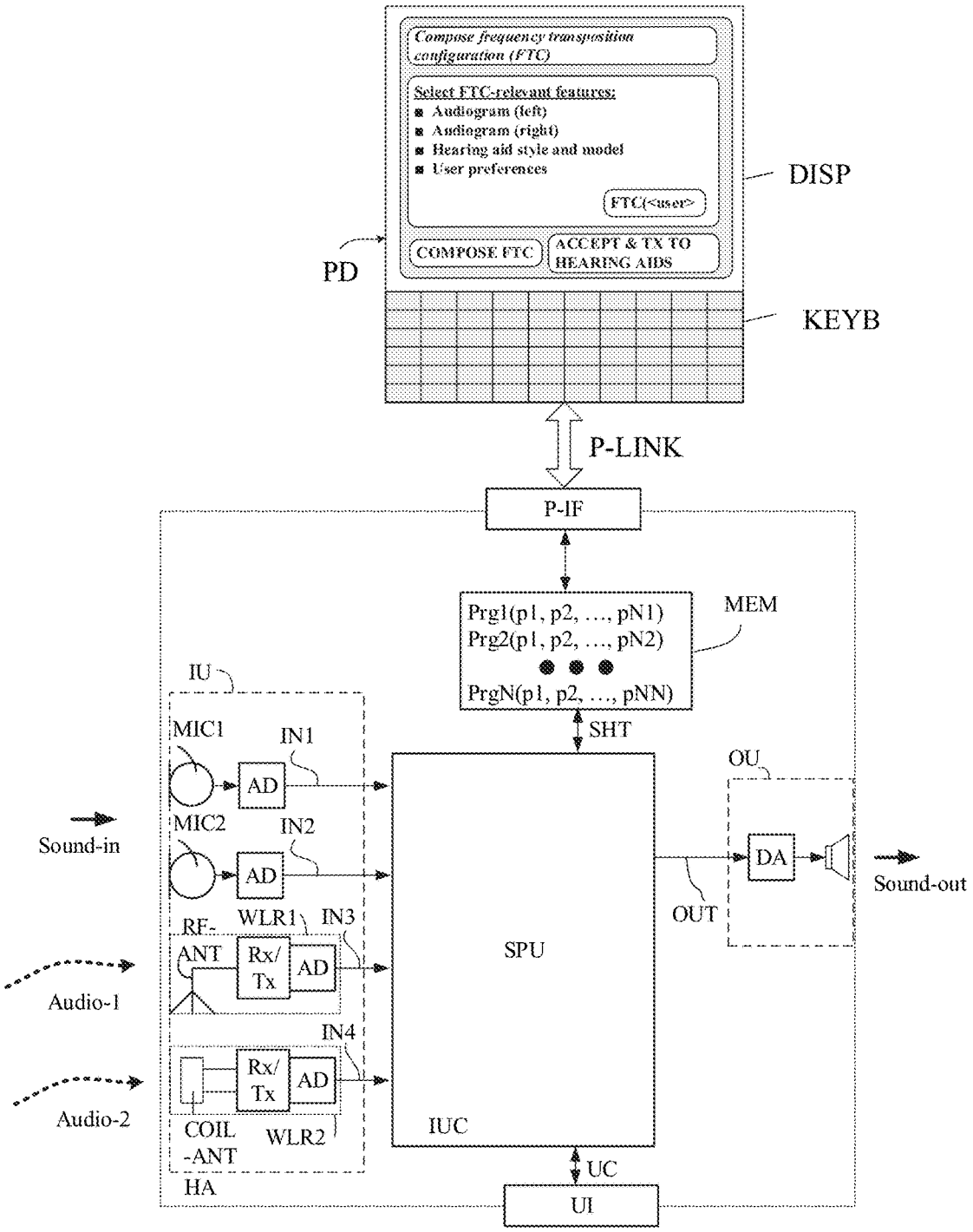
FIG. 1 shows an embodiment of a configurable hearing system according to the present disclosure comprising a hearing aid device in communication with a programming device.

FIG. 1 shows an embodiment of a configurable hearing system according to the present disclosure comprising a hearing aid device in communication with a programming device. The embodiment of a configurable hearing system shown in FIG. 1 comprises a programming device (PD) for programming a hearing device (HA) (e.g. in a separate fitting session before the hearing device is taken into use by a specific user). The programming device is connected to the configurable hearing device via a communication link (P-LINK) and a programming interface (P-IF) on the hearing device (HA). Different programs (Prgi, and associated parameters p1, p2, . . . , PNi, i=1, 2, . . . , N) can be provided in the fitting system. At least one of the programs, e.g. PrgN comprises a frequency transposition element according to the present disclosure (see exemplary screen 'Compose frequency transposition configuration (FTC)' and exemplary relevant features for such composition, cf. Select FTC-relevant features) as displayed on display screen (DISP) of the programming device (PD) (e.g. a PC). A number of different frequency transposition categories can be selected according to the user's audiogram(s) (e.g. for the left and right ears of the user), the hearing aid style (e.g. RITE, BTE, CIC, etc.) and the specific model (and possibly user preferences). In an embodiment, a relevant frequency transposition category is selected among a number of different predefined frequency transposition categories (cf. FIG. 3) and transferred to the memory (MEM) of the hearing device (HA), e.g. using a user interface of the programming device; here exemplified by a keyboard (KEYB) and/or a display (DISP), e.g. a touch sensitive display.

It is assumed that the programming device, e.g. a fitting system, (PD) has available user specific data, such as data defining a hearing ability (e.g. hearing loss compared to a normal), e.g. including data from an audiogram, uncomfortable levels, user preferences, etc. In an embodiment, the fitting system comprises a fitting rationale, e.g. NAL (and/or a proprietary fitting algorithm). Based on such fitting rationale, appropriate technical feature parameter settings may be derived for each technical feature of a given performance category (based on knowledge of the technical feature (e.g. comprising one or more algorithms), the user's hearing ability, the hearing device (e.g. its style and specifications of its functional components, such as microphones, loudspeaker, delays, etc.). In an embodiment, the fitting system is configured to (automatically) determine the relevant frequency transposition configuration (and corresponding program parameters) for a given style of a particular hearing device (cf. button 'COMPOSE FTC' in FIG. 1). The thus determined parameters for selected or determined frequency transposition configuration (and corresponding program parameters) can be transferred to the hearing device (HA) via the communication link (P-LINK) and a programming interface (P-IF), e.g. wireless interface (cf. button 'ACCEPT & TX TO HEARING AIDS' in FIG. 1).

The hearing aid device of FIG. 1 comprises an input unit (IU) comprises two input transducers and two wireless transceivers. The two input transducers each comprises respective microphones (MIC1, MIC2) and associated analogue to digital converters (AD) providing electric input audio signals IN1 and IN2, respectively, based on sound signals (Sound-in) impinging on the microphones. The two wireless transceivers (WLR1, WLR2) each comprises respective antenna (RF-ANT, COIL-ANT) and transceiver circuitry (Rx/Tx) and associated analogue to digital converters (AD) providing input signals IN3 and IN4, respectively. A first wireless receiver (RF-ANT, Rx/Tx, AD) is configured to receive (and optionally transmit) electromagnetic signals (Audio-1) based on radiated fields, e.g. at 2.4 GHz, e.g. according to the Bluetooth standard or equivalent. A second wireless receiver (COIL-ANT, Rx/Tx, AD) is configured to receive (and optionally transmit) signals based on near-field communication (Audio-2), e.g. on an inductive coupling between closely located coil antennas (COIL-ANT), e.g. at frequencies below 100 MHz, e.g. around 5 MHz. In an embodiment, the input unit (IU) further comprise time to time-frequency conversion units (e.g. analysis filter banks)

to avail the electric input signals IN1-IN4 in a number if frequency bands. In an embodiment, at least a part of the processing of the signal processing unit is performed in a number of frequency bands. In an embodiment, the output unit (OU) comprises a corresponding time-frequency to time conversion unit (e.g. a synthesis filter bank) to provide the output signal in the time domain. Electric input audio signals IN1-IN4 are fed to the signal processing unit (SPU) comprising respective selection units (0/1) for enabling or disabling the individual electric input audio signals (based on performance category parameters of a given—currently active—performance category, indicated by control signal IUC from the signal processing unit). The memory unit (MEM) is shown to have stored specific program parameters (p1, p2, . . . pNi), a currently selected one being loaded into the working memory of the signal processing unit (SPU). The output unit OU comprises a digital to analogue converter (DA) for converting the enhanced output signal from the signal processing unit to an analogue signal which is converted to on output sound (Sound-out) by an output transducer (here a loudspeaker). The currently selected performance category is e.g. selected by the user via the user interface. In an embodiment the configurable hearing device (HA) further comprises an environment classification unit for classifying the present acoustic environment of the user (hearing device). Such classification data may advantageously be logged by a data logger together with other usage specific data.

Figure 2:
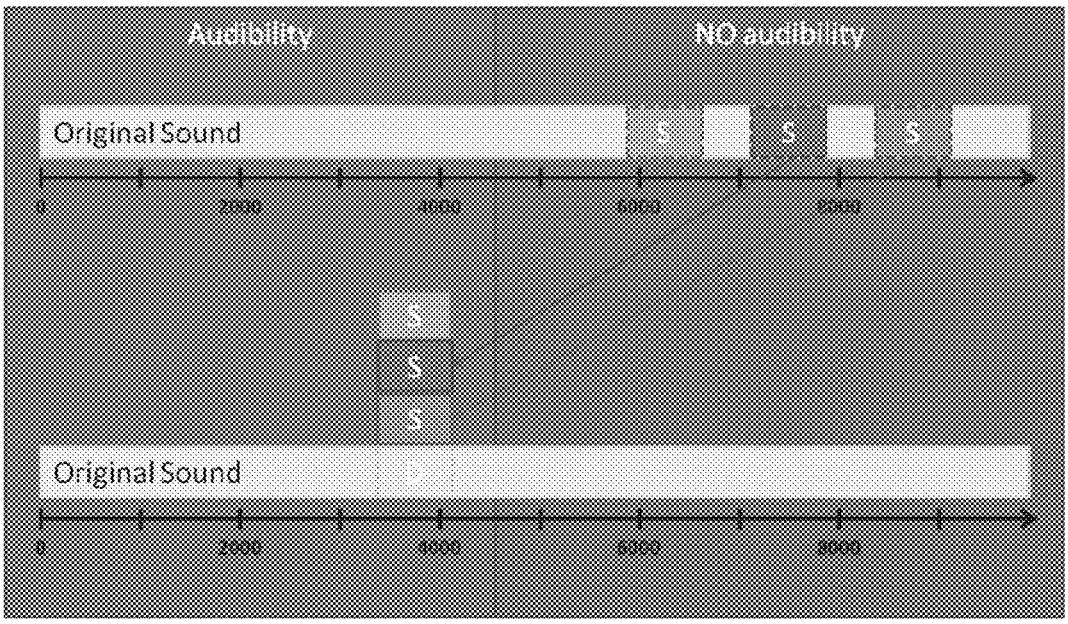
FIG. 2 shows an exemplary frequency lowering (copying) of signal content from 3 (higher lying) source frequency bands to a single (lower lying) destination frequency band.

FIG. 2 shows an exemplary frequency lowering (copying) of signal content from 3 (higher lying) source frequency bands to a single (lower lying) destination frequency band. FIG. 2 shows in its upper and lower parts a frequency axis from 0 to 10 kHz and an indication of an exemplary user's ability to hear a specific sound level (Original Sound in FIG. 2) below a threshold frequency $f_{TH}$, e.g. 4.5 kHz (Audibility indication in FIG. 2), and NOT to hear the sound above the threshold frequency $f_{TH}$. (NO audibility indication in FIG. 2). The upper part indicates sound content (S) in three different (source) frequency bands (of identical width, e.g. 800 Hz), here spatially separated (not neighbouring bands) above the threshold frequency $f_{TH}$.=4.5 kHz. In the lower part of FIG. 2, the 3 frequency bands indicated in the upper part are transposed (lowered, moved or copied, here shown to be moved, i.e. not maintained in their original location) down to a destination frequency band (D) below around 4 KHz. The contents of the three source bands (S) is added to the destination band (D), which is indicated to be of the same width as the source bands (e.g. 800 Hz).

In an embodiment, a hearing aid system according to the present disclosure comprises four components:

1. Frequency transposition algorithm in the hearing aid where content from more than one upper-lying (source) frequency band is copied into one and the same lower lying (destination) frequency band (cf. FIG. 2). Each combination of source regions and destination region is called a frequency transposition configuration (cf. FIG. 3).
2. A number of frequency transposition configurations (cf. FIG. 3). The bandwidth of each of the source and destination regions in a given frequency transposition configuration is denoted by an integer specifying the number of ERBs.
3. A weight parameter that specifies the amount of gain applied to the lowered signal.
4. A prescription algorithm that selects an optimum configuration for each ear of the end-user's ears taking the audiogram and the amplification capability of the hearing aid into account.

The four components described here ensures that exactly the right information used for decoding speech is made available to the individual hearing impaired ear. Components 1 and 2 selects source regions covering the high frequency bandwidth with relevant speech cues and components 3 and 4 ensures that these speech cues are presented optimally in terms of audibility. In this way, a hearing aid program of a hearing aid device according to the present disclosure comprising frequency lowering can be optimized as a whole.

The fact that more source regions are lowered to the same destination region reflects an optimized compromise between making a large amount of information available and distorting the original signal. Previously suggested transposition methods do not use this optimization and have not shown the performance that this method has in terms of speech intelligibility. Previously suggested frequency compression methods inherently do not have the flexibility to optimize the configurations described here.

The frequency lowering scheme of the present disclosure, wherein content from 2 or more higher lying source frequency bands is added to one lower lying destination frequency band is preferably applied before a level compression algorithm is applied to the signal. Thereby it can be ensured that possible 'excess content' (level above a predefined level for the user) can be appropriately attenuated.

In an embodiment, the source bands are copied to the destination band but also kept in their original location. This may improve speech intelligibility for some users.

In an embodiment, the source bands are moved to the destination band (not kept in their original location). This has the advantage of saving processing power and power to drive the output transducer/electrodes.

Figure 3:
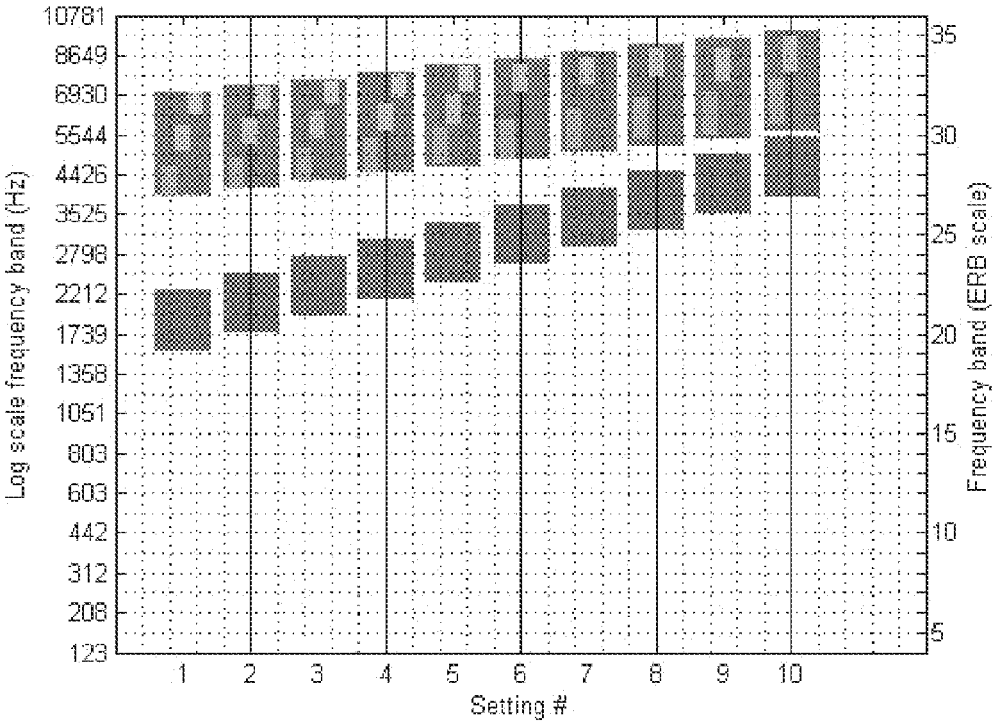
FIG. 3 shows a number of frequency transposition configurations according to the present disclosure.

FIG. 3 shows a number of frequency transposition configurations according to the present disclosure. FIG. 3 illustrates 10 different frequency transposition configurations that are selectable in the programming device depending on a users' hearing ability (e.g. an audiogram) and the technical specifications of a chosen hearing aid style and model. The different frequency transposition configuration comprises 2 or 3 source frequency bands at relatively high frequencies e.g. above a threshold frequency $f_{TH}$ for the given frequency transposition configuration that are transposed down into a (single) destination frequency band below the threshold frequency $f_{TH}$.

The left vertical scale in FIG. 3 indicates the frequency bands of an exemplary hearing aid in a logarithmic frequency scale (between 123 Hz and 10781 Hz). The right vertical scale in FIG. 3 indicates the frequency bands in an ERB scale (between 5 and 35).

In an embodiment, the bandwidth of each of the source and destination regions in a given frequency transposition configuration is denoted by an integer specifying the number of ERBs that the region in question spans (ERB=Equivalent rectangular bandwidth, frequency scale based on the human ear). In an embodiment, the source region of a given frequency transposition configuration spans 4 ERBs, while the destination region spans 3 ERBs.

The illustrated frequency transposition configurations are each defined by a source and a destination frequency region. A source frequency region is spanned by a minimum and a maximum source frequency [fmin(Si); fmax(Si)], i=1, 2, . . . , 10 being the setting number of the horizontal axis in FIG. 3. Likewise, the destination frequency region is spanned by a minimum and a maximum destination frequency [fmin(Di); fmax(Di)], i=1, 2, . . . , 10.

The source and destination frequency ranges of FIG. 3 exhibit increasing minimum and a maximum source frequencies [fmin(Si); fmax(Si)], and increasing minimum and a maximum destination frequencies [fmin(Di); fmax(Di)] with increasing i=1, 2, . . . , 10.

It is observed, though, that the 10 exemplary (carefully designed) frequency transposition configurations have a decreasing distance between the maximum frequency of the destination frequency region (band) (D) and the minimum frequency of the source frequency region (with increasing setting #, i) (on a logarithmic frequency scale).

Likewise, it is seen from FIG. 3 that the threshold frequency $f_{TH}$ between the source frequency range and the destination frequency range increases with increasing setting number i. The threshold frequency $f_{TH}$ may define the threshold between audibility and NO audibility for a specific hearing impaired user (cf. FIG. 2), e.g. for a given sound level. The threshold frequency $f_{TH}$ may thus correspond to a maximum audible frequency (MAF) for a given user. The MAF may be used as an input to selecting an appropriate one of the 10 predefined frequency transposition configurations for a given user.

Figure 4:
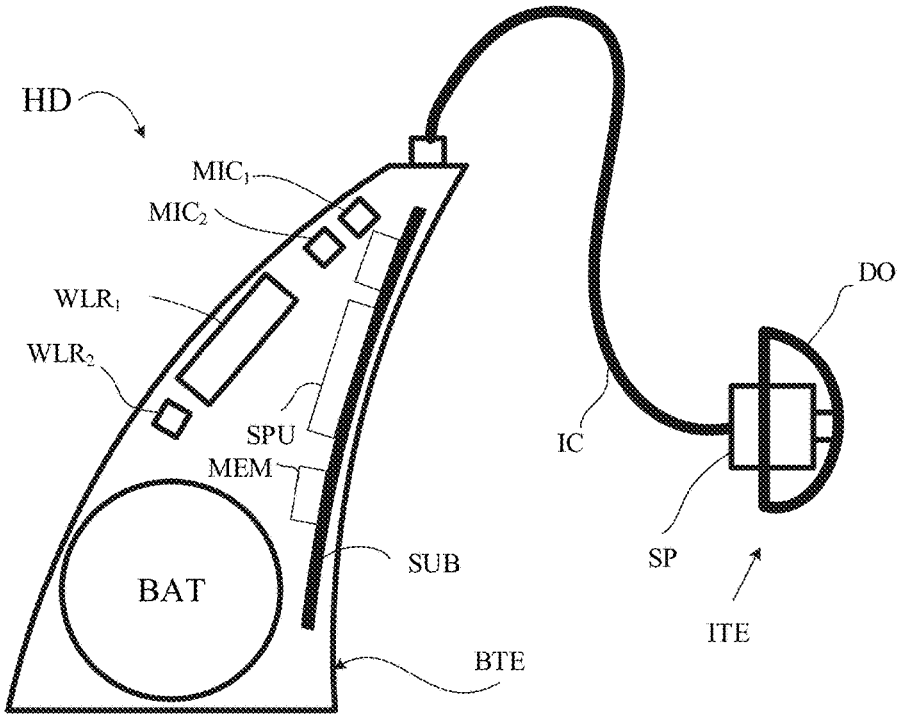
FIG. 4 shows an exemplary hearing aid device which may form part of a hearing aid system according to the present disclosure.

FIG. 4 shows an exemplary hearing device, which may form part of a configurable hearing system according to the present disclosure. The hearing aid device (HD), e.g. a hearing aid, is of a particular style (sometimes termed receiver-in-the ear, or RITE, style) comprising a BTE-part (BTE) adapted for being located at or behind an ear of a user and an ITE-part (ITE) adapted for being located in or at an ear canal of a user's ear and comprising a receiver (loudspeaker). The BTE-part and the ITE-part are connected (e.g. electrically connected) by a connecting element (IC).

In the embodiment of a hearing device in FIG. 4, the BTE part comprises an input unit comprising two (individually selectable) input transducers (e.g. microphones) ($MIC_1$, $MIC_2$) each for providing an electric input audio signal representative of an input sound signal. The input unit further comprises two (individually selectable) wireless receivers ($WLR_1$, $WLR_2$) for providing respective directly received auxiliary audio input signals. The hearing device (HA) further comprises a substrate SUB whereon a number of electronic components are mounted, including a memory (MEM) storing at least two different programs (Prgn in FIG. 1), at least one of which (e.g. PrgN) comprises frequency lowering defined by a specific frequency transposition configuration, implemented by a specific parameter setting (see (p1, p2, . . . , PNN) in FIG. 1). The BTE-part further comprises a configurable signal processing unit (SPU) adapted to access the memory (MEM) and for selecting and processing one or more of the electric input audio signals and/or one or more of the directly received auxiliary audio input signals, based on a currently selected one of the at least two different programs (and corresponding parameter settings). The configurable signal processing unit (SPU) provides an enhanced audio signal (cf. e.g. signal OUT in FIG. 1), which may be presented to a user or further processed or transmitted to another device as the case may be.

The hearing device (HA) further comprises an output unit (e.g. an output transducer or electrodes of a cochlear implant) providing an enhanced output signal as stimuli perceivable by the user as sound based on said enhanced audio signal or a signal derived therefrom In the embodiment of a hearing device in FIG. 4, the ITE part comprises the output unit in the form of a loudspeaker (receiver) (SP) for converting a signal to an acoustic signal. The ITE-part further comprises a guiding element, e.g. a dome, (DO) for guiding and positioning the ITE-part in the ear canal of the user.

The hearing device (HD) exemplified in FIG. 4 is a portable device and further comprises a battery (BAT) for energizing electronic components of the BTE- and ITE-parts.

In an embodiment, the hearing device, e.g. a hearing aid, is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

The hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

The hearing device comprises an input unit for providing an electric input signal representing sound. The input unit comprises one or more input transducers (e.g. microphones) ($MIC_1$, $MIC_2$) for converting an input sound to an electric input signal. The input unit comprises one or more wireless receivers ($WLR_1$, $WLR_2$) for receiving (and possibly transmitting) a wireless signal comprising sound and for providing corresponding directly received auxiliary audio input signals. In an embodiment, the hearing device comprises a directional microphone system (beamformer) adapted to enhance a target acoustic source among a multitude of acoustic sources in the local environment of the user wearing the hearing device. In an embodiment, the directional system is adapted to detect (such as adaptively detect) from which direction a particular part of the microphone signal originates.

In an embodiment, the hearing device comprises an antenna and transceiver circuitry for wirelessly receiving a direct electric input signal from another device, e.g. a communication device or another hearing device. In an embodiment, the hearing device comprises a (possibly standardized) electric interface (e.g. in the form of a connector) for receiving a wired direct electric input signal from another device, e.g. a communication device or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, the wireless link established by a transmitter and antenna and transceiver circuitry of the hearing device can be of any type. In an embodiment, the wireless link is used under power constraints, e.g. in that the hearing device comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying) or QAM (quadrature amplitude modulation).

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 50 GHz, e.g. located in a range from 50 MHz to 50 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 audio data samples. Other frame lengths may be used depending on the practical application.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a detector for classifying a current acoustic environment of the user (hearing device).

In an embodiment, the hearing device comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing device comprises an acoustic (and/or mechanical) feedback suppression system. Adaptive feedback cancellation has the ability to track feedback path changes over time. It is based on a linear time invariant filter to estimate the feedback path but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

In an embodiment, the hearing device further comprises other relevant functionality for the application in question, e.g. compression, noise reduction, etc.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A method of programming a configurable signal processing unit of a hearing aid device, the method comprising:

configuring the hearing aid device to make high frequency sound audible to a user by presenting high frequency content at lower frequencies by performing a frequency lowering process including providing a frequency transposition algorithm in the hearing aid device where content from more than one upper-lying source frequency band is copied into a single lower lying destination frequency band;

providing a number of frequency transposition configurations, each comprising a specific combination of source regions and a destination region for use by said frequency transposition algorithm;

providing a weight parameter that specifies an amount of gain applied to a lowered signal; and providing a prescription algorithm that selects an optimum frequency transposition configuration for an ear of the user taking the audiogram for the ear in question and an amplification capability of the hearing aid device in question into account.

2. A method according to claim 1 further comprising:

providing that a bandwidth of each of the source and destination regions in a given frequency transposition configuration is denoted by an integer specifying the number of equivalent rectangular bandwidths (ERBs).

3. A method according to claim 1 further comprising:

providing a prescription algorithm that selects an optimum configuration for each ear of the user's ears taking the audiogram or the respective ears of the user and the amplification capability of the respective hearing aid devices into account.

4. A method according to claim 1 further comprising:

providing a weight parameter that specifies the amount of gain applied to the lowered signal so that the level of the destination band is smaller than or equal to a predefined maximum level.

5. A method according to claim 1 comprising:

providing that the upper-lying source frequency bands are located above a threshold frequency and the lower lying destination frequency band is located below the threshold frequency, and wherein the threshold frequency corresponds to a maximum audible output frequency for a given user and a particular hearing aid device.

6. A method according to claim 1, comprising:

providing that the frequency transposition configurations are arranged so that, on a logarithmic scale, the destination region spans 3 equivalent rectangular bandwidths (ERBs); and the specific combination of source regions together span 4 equivalent rectangular bandwidths (ERBs).

7. A hearing aid system comprising:

a hearing aid device comprising a configurable signal processing unit;

a programming device configured to program the configurable signal processing unit; and a communication link allowing an exchange of data between the hearing aid device and the programming device, wherein the hearing aid system is configured to program the configurable signal processing unit of the hearing device to make high frequency sound audible to a user by presenting high frequency content at lower frequencies by performing a frequency lowering process including:

providing a frequency transposition algorithm in the hearing aid device where content from more than one upper-lying source frequency band is copied into a single lower lying destination frequency band;

providing a number of frequency transposition configurations, each comprising a specific combination of source regions and a destination region for use by said frequency transposition algorithm;

providing a weight parameter that specifies an amount of gain applied to a lowered signal; and providing a prescription algorithm that selects an optimum frequency transposition configuration for an ear of the user taking the audiogram for the ear in question and an amplification capability of the hearing aid device in question into account.

8. A hearing aid system according to claim 7 wherein the hearing aid device is or comprises a hearing aid.

9. A data processing system comprising a processor and a non-transitory computer-readable medium storing program code for causing the processor to perform a method of programming a configurable signal processing unit of a hearing aid, the method comprising:

configuring the hearing aid device to make high frequency sound audible to a user by presenting high frequency content at lower frequencies by performing a frequency lowering process including providing a frequency transposition algorithm in the hearing aid device where content from more than one upper-lying source frequency band is copied into a single lower lying destination frequency band;

providing a number of frequency transposition configurations, each comprising a specific combination of source regions and a destination region for use by said frequency transposition algorithm;

providing a weight parameter that specifies an amount of gain applied to a lowered signal; and providing a prescription algorithm that selects an optimum frequency transposition configuration for an ear of the user taking the audiogram for the ear in question and an amplification capability of the hearing aid device in question into account.

* * * * *